US008123537B2

(12) United States Patent
Tsuruta

(10) Patent No.: US 8,123,537 B2
(45) Date of Patent: Feb. 28, 2012

(54) DEVICE FOR PREVENTING UNAUTHORIZED CONNECTION TO OUTLET

(75) Inventor: Hiroshi Tsuruta, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 13/023,080

(22) Filed: Feb. 8, 2011

(65) Prior Publication Data

US 2011/0207347 A1 Aug. 25, 2011

(30) Foreign Application Priority Data

Feb. 23, 2010 (JP) ..... 2010-037218

(51) Int. Cl.
*H01R 13/44* (2006.01)

(52) U.S. Cl. ..... 439/133

(58) Field of Classification Search ..... 439/133, 439/346, 692, 825, 347
See application file for complete search history.

(56) References Cited

U.S. PATENT DOCUMENTS 3,801,757 A * 4/1974 Carissimi et al. ..... 200/50.28
4,875,874 A * 10/1989 Windsor, Jr. ..... 439/369
5,277,620 A * 1/1994 Taylor ..... 439/490

FOREIGN PATENT DOCUMENTS

JP 9-161898 6/1997

* cited by examiner

*Primary Examiner* — Tulsidas C Patel
*Assistant Examiner* — Phuong Nguyen
(74) *Attorney, Agent, or Firm* — Patterson Thuente Christensen Pedersen, P.A.

(57) ABSTRACT

An unauthorized connection prevention device use with an outlet, which is electrically connectable to a connection plug arranged on a basal end of a charging cable that supplies commercial power to a power receiving connector. The unauthorized connection prevention device includes a verification circuit that performs verification to determine whether an authorized operator is electrically connecting the connection plug to the outlet. A lock mechanism switches, in accordance with a result of the verification performed by the verification circuit, between an unlocked state, which permits connection of the connection plug to an outlet port of the outlet, and a locked state, which prohibits connection of the connection plug to the outlet port.

12 Claims, 5 Drawing Sheets

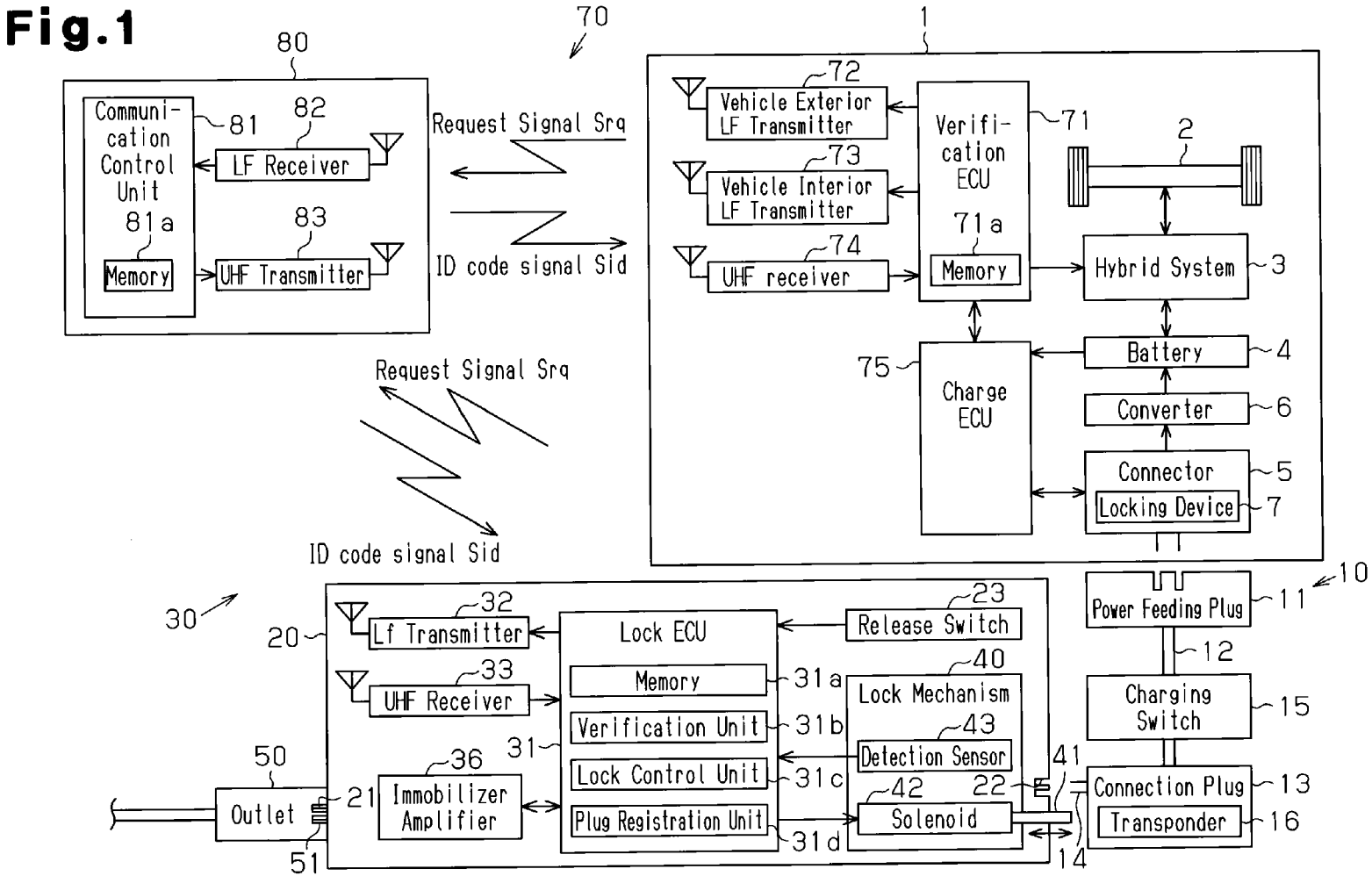
Fig.1
70
80
Communi-cation Control Unit
81
81a
Memory
LF Receiver
82
UHF Transmitter
83
Request Signal Srq
ID code signal Sid
Request Signal Srq
ID code signal Sid
1
Verifi-cation ECU
71
71a
Memory
Vehicle Exterior LF Transmitter
72
Vehicle Interior LF Transmitter
73
UHF receiver
74
Charge ECU
75
2
Hybrid System
3
Battery
4
Converter
6
Connector
5
Locking Device
7
11
10
Power Feeding Plug
12
Charging Switch
15
Connection Plug
13
Transponder
16
14
41
Release Switch
23
Lock Mechanism
40
Detection Sensor
43
Solenoid
22
42
Lock ECU
Memory
Verification Unit
Lock Control Unit
Plug Registration Unit
31a
31b
31c
31d
31
LF Transmitter
32
UHF Receiver
33
Immobilizer Amplifier
36
21
20
30
Outlet
50
51

DEVICE FOR PREVENTING UNAUTHORIZED CONNECTION TO OUTLET

CROSS-REFERENCE TO RELATED APPLICATIONS

This application is based upon and claims the benefit of priority from prior Japanese Patent Application No. 2010-37218, filed on Feb. 23, 2010, the entire contents of which are incorporated herein by reference.

BACKGROUND OF THE ART

The present invention relates to a device for preventing unauthorized connection of a plug to an outlet.

Automobile manufacturers are developing electric vehicles (including hybrid vehicles) to reduce exhaust emissions from vehicles. Such a vehicle uses a motor as a drive source. The motor is powered by a battery. Whenever the state of charge of the battery becomes low, the user of the electric vehicle must charge the battery with a charger that is installed in a household or a charging station. Charging systems that are easy for a user to use have been disclosed (for example, Japanese Laid-Open Patent Publication No. 9-161898). The prior art charging system includes a power feeding connector, which is arranged on the distal end of a charging cable connected to, for example, a household outlet for a commercial power supply. When the user is at home, the user connects the power feeding connector to a power receiving connector of the vehicle to charge the vehicle battery with commercial power.

SUMMARY OF THE INVENTION

Although fast charging technology is being developed, the time required to charge the battery of an electric vehicle is still much longer than that required to refuel a gasoline engine vehicle. For example, when a user charges the battery of an electric vehicle at home without using a quick charger, the user plugs the power feeding connector to a household outlet. Then, the user connects the power feeding connector to the power receiving connector to start charging the battery of the electric vehicle. The electric vehicle is left in this state over a long period of time.

The charging cable has a basal end to which a connection plug is attached. The plug is connected to a power outlet. A typical power outlet allows for connection of various types of electric appliances. Thus, when the vehicle battery is being charged, for example, an unauthorized person may disconnect the plug of the charging cable from the power outlet and connect the plug of another electrical appliance to steal electricity.

One aspect of the present invention is an unauthorized connection prevention device for use with an outlet. The outlet is electrically connectable to a connection plug arranged on a basal end of a charging cable that supplies commercial power to a power receiving connector. The unauthorized connection prevention device includes a verification circuit that performs verification to determine whether or not an authorized operator is electrically connecting the connection plug to the outlet. A lock mechanism switches, in accordance with a result of the verification performed by the verification circuit, between an unlocked state, which permits connection of the connection plug to an outlet port that is electrically connected to the outlet, and a locked state, which prohibits connection of the connection plug to the outlet port.

Another aspect of the present invention is an outlet unit connectable to a conventional power outlet and to a connection plug arranged on a basal end of a power feeding plug that supplies commercial power to a power receiving connector. The outlet unit includes an outlet port connectable to a plug terminal of the connection plug, a verification circuit that performs verification allowing for determination of whether an authorized operator is performing an operation for connecting the connection plug to the outlet unit, a lock mechanism switches, in accordance with a result of the verification performed by the verification circuit, between an unlocked state, which permits connection of the connection plug to the outlet port, and a locked state, which prohibits connection of the connection plug to the outlet port, and a coupling structure that connects the outlet unit to the conventional power outlet. The outlet unit prevents an unauthorized person from disconnecting the outlet unit from the conventional power outlet in an unauthorized manner.

Further aspect of the present invention is an electricity antitheft system for a commercial power outlet. The electricity antitheft system includes an outlet unit fastened to the commercial power outlet in an irremovable manner, a connection plug including a plug terminal connectable to an outlet port of the outlet unit and capable of performing wireless communication with the outlet unit, and an electronic key capable of performing wireless communication with the outlet unit. The outlet unit includes a control unit that performs wireless communication with the connection plug to determine whether or not the connection plug is authorized and performs wireless communication with the electronic key to determine whether or not the electronic key is authorized, and a lock bar controlled and driven by the control unit and moved between a retraction position, in which the lock bar is retracted into the outlet unit, and a projection position, in which the lock bar is projected out of the outlet unit from near the outlet port so that the lock bar blocks access to the outlet port by the plug terminal. The control unit moves the lock bar to the retraction position when determining that at least one of the connection plug and the electronic key is authorized. The control unit moves the lock bar to the projection position when determining that the connection plug and the electronic key are both unauthorized.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1 is a block diagram of a vehicle and a charging system;

DETAILED DESCRIPTION OF THE INVENTION

Figure 2:
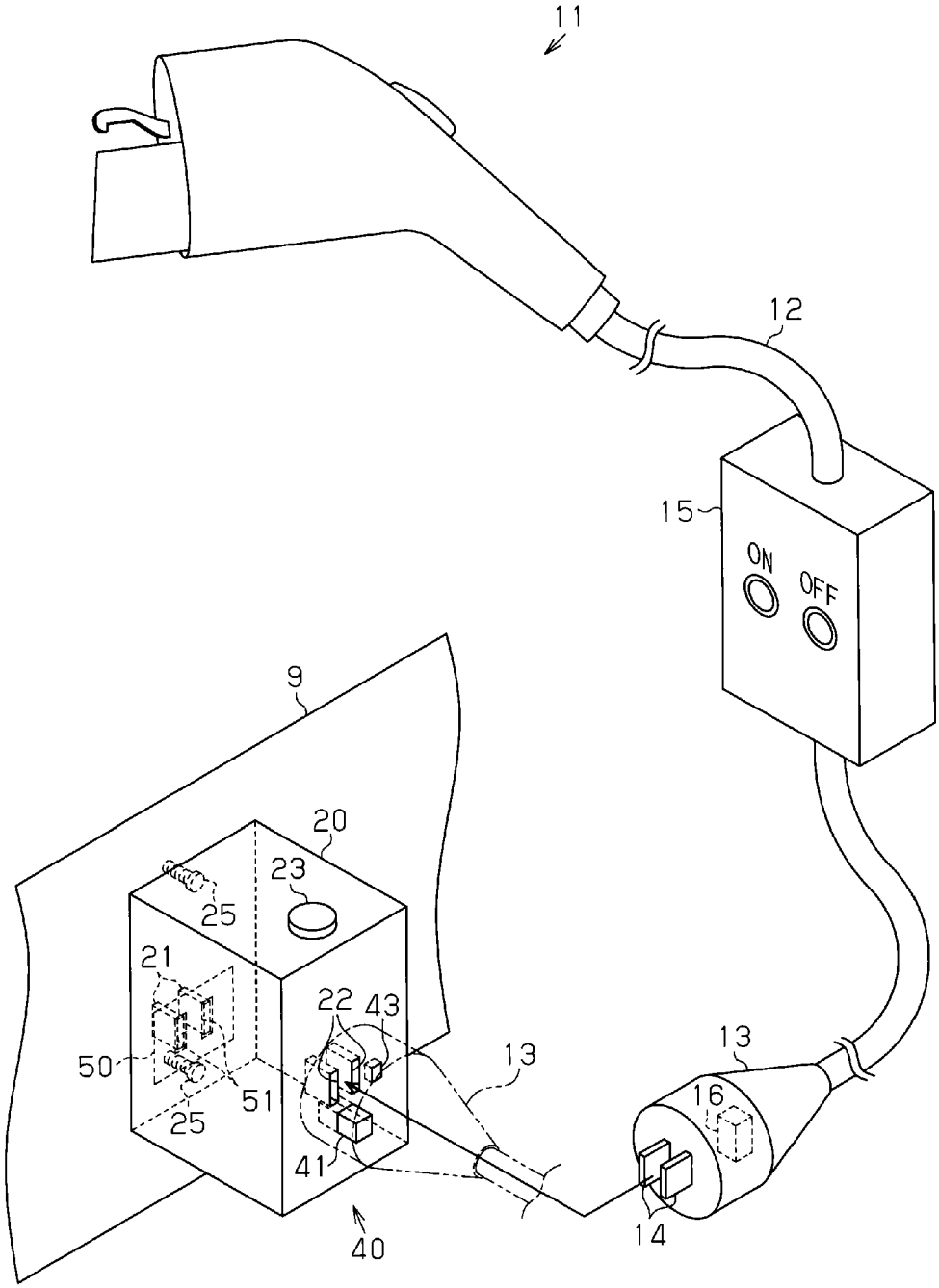
FIG. 2 is a perspective view showing a power feeding cable unit and an outlet unit that is connected to an outlet.

A device for preventing unauthorized connection to an outlet according to one embodiment of the present invention will now be discussed.

Referring to FIG. 1, a plug-in hybrid vehicle 1 includes drive wheels 2 and a hybrid system, which uses an engine and a motor independently or in combination as a drive source for driving the drive wheels 2. The hybrid system 3 operates in a mode using only the engine to drive the drive wheels 2, a mode using the motor while generating electric power with the engine to drive the drive wheels 2, a mode using both the engine and the motor to drive the drive wheels 2, and a mode using only the motor to drive the drive wheels 2. The vehicle 1 is one example of a master device.

The hybrid system 3 is connected to a battery 4, which supplies the motor with power. In addition to being charged by the power generated by the engine, the battery 4 is chargeable by an external power supply of the vehicle 1 using, for example, nighttime power supplied from a household outlet 50. The plug-in hybrid vehicle 1 is capable of traveling with just the motor over a longer distance than a conventional hybrid vehicle. This reduces the frequency of engine operation.

An electronic key system 70 is installed in the vehicle 1 so that vehicle operations such as the locking and unlocking of the doors can be performed without the driver actually operating a vehicle key. The electronic key system 70 uses an electronic key 80 as a vehicle key. The electronic key 80 is capable of transmitting a unique ID code through wireless communication. In the electronic key system 70, the vehicle 1 transmits an ID code response request signal Srq. In response to the request signal Srq, the electronic key 80 sends back an ID code signal Sid, which includes its ID code, to the vehicle 1 through narrowband wireless communication. When the ID code of the electronic key 80 conforms to an ID code of the vehicle 1, the electronic key system 70 permits or performs the locking and unlocking of the doors. The electronic key system 70 is one example of a wireless authentication system. The electronic key 80 is one example of a communication terminal.

The electronic key system 70 will now be described. The vehicle 1 includes a verification electronic control unit (ECU) 71, which verifies the ID code in the ID code signal Sid returned from the electronic key 80 through narrowband wireless communication. The verification ECU 71 is connected to a vehicle exterior low frequency (LF) transmitter 72, a vehicle interior LF transmitter 73, and an ultrahigh frequency (UHF) receiver 74. The LF transmitter 72 is arranged in each door of the vehicle 1 and transmits wireless signals out of the vehicle in the LF band. The LF transmitter 73 is arranged in the vehicle under the floor or the like and transmits wireless signals to the interior of the vehicle 1 in the LF band. The UHF receiver 74 is arranged in the rear of the vehicle body or the like to receive wireless signals in the UHF band. The verification ECU 71 includes a memory 71*a*, which stores an ID code as a unique key code.

The electronic key 80 includes a communication control unit 81, which functions to perform wireless communication with the vehicle 1 in compliance with the electronic key system 70. The communication control unit 81 includes a memory 81*a*, which stores an ID code as a unique key code. The communication control unit 81 is connected to an LF receiver 82, which receives signals in the LF band, and a UHF transmitter 83, which transmits signals in the UHF band in accordance with commands from the communication control unit 81.

The verification ECU 71 intermittently transmits a request signal Srq in the LF band from the vehicle exterior LF transmitter 72 at a predetermined controlled timing and forms a vehicle exterior communication area near the vehicle 1. When the electronic key 80 enters the vehicle exterior communication area and receives the request signal Srq with the LF receiver 82, the electronic key 80 sends back an ID code signal Sid including the ID code in the UHF band from the UHF transmitter 83 in response to the request signal Srq. When receiving the ID code signal Sid with the UHF receiver 74, the verification ECU 71 compares the ID code registered in its memory 71*a* with the ID code of the electronic key 80 to perform ID verification (vehicle exterior verification) on the electronic key 80. When vehicle exterior verification is successful, the verification ECU 71 permits or performs locking and unlocking of the doors with a door lock (not shown).

When recognizing that the doors have been unlocked upon successful vehicle exterior verification and that the driver has opened a door and entered the vehicle 1, the verification ECU 71 transmits a request signal Srq from the vehicle interior LF transmitter 73 to form a vehicle interior communication area throughout the vehicle interior. The electronic key 80 enters the vehicle interior communication area and returns an ID code signal Sid in response to the request signal Srq. When the UHF receiver 74 receives the ID code signal Sid, the verification ECU 71 verifies the ID code of the electronic key 80 with the ID code registered in the memory 71*a* to perform ID verification (vehicle interior verification) on the electronic key 80. When vehicle interior verification is successful, the verification ECU 71 permits the starting of the hybrid system.

A plug-in vehicle battery charging system 10 will now be discussed. The charging system 10 charges the battery 4 of the vehicle 1 with an external power supply such as an outlet 50, which is arranged in, for example, a household or a commercial facility. The external power supply may be, for example, a commercial power grid that supplies 200 V of AC power. As shown in FIG. 1, the charging system 10 includes a charging cable 12, which has one end defining a power feeding plug 11 and another end defining a connection plug 13. The connection plug 13 includes plug terminals 14 connectable to outlet ports 51 of the outlet 50. The charging cable 12 includes a charging switch 15. In this specification, the power feeding plug 11, the charging cable 12, and the connection plug 13 are referred to as a charging cable unit.

To charge the battery 4 of the hybrid vehicle 1, the power feeding plug 11 is connected to a power receiving connector 5 of the vehicle 1. The power receiving connector 5, which receives the power feeding plug 11, is installed, for example, in the front side wall of the vehicle body in the same manner as a fuel tank opening of a gasoline vehicle. The power receiving connector 5 uses a converter 6 to convert the AC power from the power feeding plug 11 to DC voltage and charges the battery 4 of the vehicle 1 with the DC voltage. When the power feeding plug 11 is inserted into the power receiving connector 5 and the ID code of the electronic key 80 carried by the user is successfully verified, the power receiving connector 5 is permitted to charge the battery 4. The vehicle exterior communication area is formed around the entire vehicle 1. Further, the vehicle 1 constantly generates a key inquiry (transmits a request signal Srq) so as to perform polling. Thus, ID verification is performed as long as the user is carrying the electronic key 80. The user does not have to manually operate the electronic key.

The vehicle 1 includes a charge ECU 75, which executes charging-related control. The charge ECU 75 is communicable with the verification ECU 71 through an in-vehicle local area network (LAN) and is capable of checking the verification ECU 71 for ID verification results. The charge ECU 75, which is connected to the power receiving connector 5, detects connection of the power feeding plug 11 to the power receiving connector 5. When the power feeding plug 11 is connected to the power receiving connector 5 and the electronic key 80 is successfully verified, the charge ECU 75 permits charging. In the illustrated example, the power receiving connector 5 includes a locking device 7, which prevents unauthorized disconnection of the power feeding plug 11 from the power receiving connector 5.

The outlet 50 is connected to an outlet unit 20. When the connection plug 13 is registered to the outlet unit 20 and thus authorized, the outlet unit 20 permits connection to the outlet unit 20. However, when the connection plug 13 is one that is not registered and thereby is not granted connection permission, the outlet unit 20 prohibits connection to the outlet unit 20. Further, an unauthorized disconnection prevention mechanism, which will be described later, functions to prevent disconnection of the outlet unit 20 from the outlet 50 unless the authorized electronic key 80 is carried by the person attempting disconnection.

The outlet unit 20 includes a lock mechanism 40, which permits connection of only the authorized connection plug 13 to the outlet unit 20. The lock mechanism 40, which is arranged near an output terminal or outlet ports 22 of the outlet unit 20, includes a lock bar 41 and a solenoid 42. The lock bar 41 is movable between a retraction position and a projection position. The solenoid 42 drives the lock bar 41. The solenoid 42 is a keep type solenoid. When current flows to the solenoid 42 in the forward direction for a short period of time, the lock bar 41 is moved to the retraction position and retracted into the outlet unit 20. In this state, the outlet unit 20 is unlocked (plug connection permission state). After current stops flowing in the forward direction, the lock bar 41 remains at the retraction position. Thus, the lock mechanism 40 remains in an unlocked state (refer to FIG. 4). In contrast, when current flows to the solenoid 42 in the reverse direction for a short period of time, the lock bar 41 is moved to a projection position and projected out of the outlet unit 20. In this state, the outlet unit is locked (plug connection prohibition state). After current stops flowing in the reverse direction, the lock bar 41 remains at the projection position. Thus, the lock mechanism 40 remains in a locked state (refer to FIG. 3). The solenoid 42 functions as an electric restriction mechanism driven by an electric drive source. The lock bar 41 is referred to as a restriction member.

When the connection plug 13 is not connected to the outlet unit 20, the lock mechanism 40 is in the locked state. The lock bar 41, which is located at the projection position in the locked state, prevents an unauthorized person or the like from electrically connecting a non-registered connection plug, which has not been granted connection permission, to the outlet ports 22 of the outlet unit 20. When it is determined that an authorized user is connecting the connection plug 13 to the outlet unit 20, the lock mechanism 40 switches to the unlocked state. When the user is unauthorized, the lock mechanism 40 remains in the lock state.

As shown in FIG. 2, the outlet unit 20 has a rear surface, from which connection terminals 21 extend, and a front surface, in which the outlet ports 22 are formed. The connection terminals 21 on the rear surface are connectable to the outlet ports 51 of the outlet 50, which is arranged in a household or a commercial facility. The outlet ports 22 on the front surface are capable of receiving the plug terminals 14 of the connection plug 13. The outlet 50 to which the outlet unit 20 is connectable may be a conventional one.

A release switch 23 is arranged in the outer surface of the outlet unit 20. The release switch 23 is operated when unlocking the lock mechanism 40, that is, when connecting the connection plug 13 to the outlet ports 22 of the outlet unit 20. The release switch 23 is, for example, a momentary type push switch. In the illustrated example, one condition for unlocking the lock mechanism 40 is the release switch 23 is pushed. The release switch 23 is one example of a mechanical operation unit.

As shown in FIG. 1, the outlet unit 20 includes a lock ECU 31, which manages the operation of the outlet unit 20. The lock ECU 31 is connected to the solenoid 42 and detection sensor 43, which are arranged in the lock mechanism 40. The detection sensor 43 monitors whether or not the connection plug 13 is connected to the outlet unit 20. When detecting disconnection of the connection plug 13 from the outlet unit 20, the detection sensor 43 sends a detection signal to the lock ECU 31. When receiving the detection signal and determining that the connection plug 13 has been disconnected from the outlet unit 20, the lock ECU 31 switches the lock mechanism 40 to the locked state.

The outlet unit 20 also includes an outlet verification system 30, which verifies that the connection plug 13 is the authorized plug. In the illustrated example, the outlet verification system 30 includes an immobilizer amplifier 36, which is similar to that used in a vehicle immobilizer system, and the lock ECU 31, which is connected to the immobilizer amplifier 36. The outlet verification system 30 performs near field communication with the connection plug 13 and performs ID verification on the connection plug 13. The connection plug 13 includes a transponder 16. A transponder code such as that used in a vehicle immobilizer system is registered to the transponder 16. The transponder 16 exchanges near field communication signals with the immobilizer amplifier 36. The outlet verification system 30 is also referred to as an outlet wireless authentication system. The transponder 16 is one example of an authentication tag.

The lock ECU 31 functions as a control unit of the outlet verification system 30. The lock ECU 31 is connected to the immobilizer amplifier 36. The lock ECU 31 includes a memory 31*a*, which stores a transponder code. In the lock ECU 31, a verification unit 31*b* compares the transponder code stored in the memory 31*a* with the transponder code of the transponder 16 to perform ID verification on the connection plug 13 (also referred to as plug ID verification). The verification unit 31*b* is one example of a verification circuit. The verification unit 31*b* and a lock control unit 31*c* are also referred to as an authentication circuit.

When the release switch 23 is pushed, the outlet verification system 30 starts to transmit drive radio waves from the immobilizer amplifier 36. As the user moves the connection plug 13 to the outlet unit 20 while pushing the release switch 23, the drive radio waves transmitted from the immobilizer amplifier 36 activate the transponder 16 of the connection plug 13. Then, the transponder 16 transmits a transponder signal, which includes a transponder code. The immobilizer amplifier 36 receives the transponder signal and provides the lock ECU 31 with the received signal. In the lock ECU 31, the verification unit 31*b* performs plug ID verification based on the transponder code of the received signal. The plug ID verification is performed with only the connection plug 13 and does not use the electronic key 80. Further, the plug ID verification is performed when switching the lock mechanism 40 of the outlet unit 20 to the unlocked state and when registering a non-registered connection plug to the outlet unit 20. The immobilizer amplifier 36 forms a plug ID verification wireless communication circuit.

The outlet verification system 30 includes a key verification system, which performs ID verification on the electronic key 80 by communicating with the electronic key 80 in compliance with the electronic key system 70. The key verification system is used when determining whether or not the user of the connection plug 13 is the authorized user and when connecting a non-registered plug (including a new connection plug 13) to the outlet unit 20. The key verification system performs ID verification in the same manner as the electronic key system 70 and permits connection to the outlet ports 22 of the outlet unit 20 when ID verification of the electronic key 80 is successful. The key verification system corresponds to a wireless authentication system.

The key verification system is similar to the structure of the electronic key system 70. The lock ECU 31 functions as a control unit of the key verification system. The lock ECU 31 is connected to an LF transmitter 32, which transmits signals in the LF band, and a UHF receiver 33, which receives signals in the UHF band. The memory 31*a* of the lock ECU 31 stores an ID code that is a key code unique to the verification unit 31*b*.

The verification unit 31*b* of the lock ECU 31 intermittently transmits a request signal Srq in the LF band from the LF transmitter 32 at a predetermined controlled timing and forms a communication area near the outlet unit 20. When the electronic key 80 enters the communication area and receives the request signal Srq with the LF receiver 82, the electronic key 80 sends back an ID code signal Sid on the UHF band from the UHF transmitter 83 in response to the request signal Srq. The ID code signal Sid includes the ID code registered in the memory 81*a* of the electronic key 80. When receiving the ID code signal Sid with the UHF receiver 33, the verification unit 31*b* compares the ID code registered in the memory 31*a* with the ID code of the electronic key 80 to perform ID verification on the electronic key 80 (also referred to as electronic key ID verification). The UHF receiver 33 forms a wireless communication circuit used for communication terminal verification.

The lock ECU 31 includes the lock control unit 31*c*, which serves as a control circuit for controlling the operation of the lock mechanism 40. As described above, when connecting the connection plug 13 to the outlet unit 20, the user must push the release switch 23. When determining that the release switch 23 is being pushed, the verification unit 31*b* performs ID verification. In detail, the verification unit 31*b* first performs plug ID verification. Then, when plug ID verification is unsuccessful, the verification unit 31*b* performs electronic key ID verification. The fact that either the plug ID verification or the electronic key ID verification is successful indicates that the authorized connection plug 13 is being used or that the authorized electronic key 80 is located near the outlet unit 20. A proper user, such as an authorized user, carries the authorized electronic key 80 or authorized connection plug 13. However, it would be difficult for an unauthorized person to obtain the authorized electronic key 80 or authorized connection plug 13. Accordingly, when the plug ID verification or the electronic key verification is successful, it can be assumed that the authorized user is attempting to connect a connection plug to the outlet unit 20. Thus, when determining that plug ID verification or electronic key ID verification has been successful through communication with the verification unit 31*b*, the lock control unit 31*c* permits the supply of current to the solenoid 42. When supplied with current, the solenoid 42 generates a magnetic field to retract the lock bar 41 from the projection position into the outlet unit 20. This switches the lock mechanism 40 to the unlocked state and allows the plug terminals 14 of the connection plug 13 to be connected to the outlet ports 22 of the outlet unit 20.

When the lock control unit 31*c* communicates with the verification unit 31*b* and determines that plug ID verification and electronic key ID verification were both unsuccessful, the lock control unit 31*c* keeps the solenoid 42 deactivated. In this case, the lock bar 41 remains at the projection position. Thus, the plug terminals 14 of the connection plug 13 cannot be connected to the outlet ports 22 of the outlet unit 20. The solenoid 42 is normally deactivated. The solenoid 42 is activated only when the release switch 23 is operated and the plug ID verification or electronic key ID verification is successful.

When the connection plug 13 is disconnected from the outlet unit 20, the lock control unit 31*c* supplies the solenoid 42 with current. The solenoid 42 generates a magnetic field in the reverse direction and moves the lock bar 41 from the retraction position to the projection position. This shifts the lock mechanism 40 to the locked state. To connect the disconnected connection plug 13 again to the outlet ports 22 of the outlet unit 20, plug ID verification or electronic key verification must be successful.

When plug ID verification is unsuccessful but electronic key ID verification is successful, a non-registered connection plug may be connected to the outlet unit 20. In detail, the user, who is carrying an authorized key, namely, the electronic key 80 that corresponds to the outlet unit 20, pushes the release switch 23. When the verification unit 31*b* determines that the release switch 23 has been pushed, the verification unit 31*b* performs electronic key ID verification. Since the electronic key 80 is authorized, the electronic key ID verification performed by the verification unit 31*b* is successful, and the lock control unit 31*c* switches the lock mechanism 40 to the unlocked state. This allows for the non-registered connection plug to be connected to the outlet ports 22 of the outlet unit 20. The lock control unit 31*c* functions as a non-registered plug connection circuit.

The lock ECU 31 includes a plug registration unit 31*d*, which serves as a registration circuit that registers non-registered connection plugs. The procedures for registering a non-registered connection plug to the outlet unit 20 will now be described. First, the plug registration unit 31*d* is activated by the electronic key 80, for example. In this state, plug ID verification is performed with the transponder of the non-registered connection plug to obtain the transponder code of the non-registered connection plug. The plug registration unit 31*d* registers the obtained transponder code to the memory 31*a*. This registers the connection plug as an authorized connection plug to the outlet unit 20. Subsequent to the registration, the connection plug becomes connectable to the outlet unit 20 after undergoing successful ID verification even when the electronic key 80 is not present.

A combination of the outlet unit 20, the connection plug 13, and the electronic key 80 may be referred to as an electricity antitheft system.

A structure and method for coupling the outlet unit 20 to the outlet 50 will now be discussed with reference to FIGS. 5 and 6.

Figure 5:
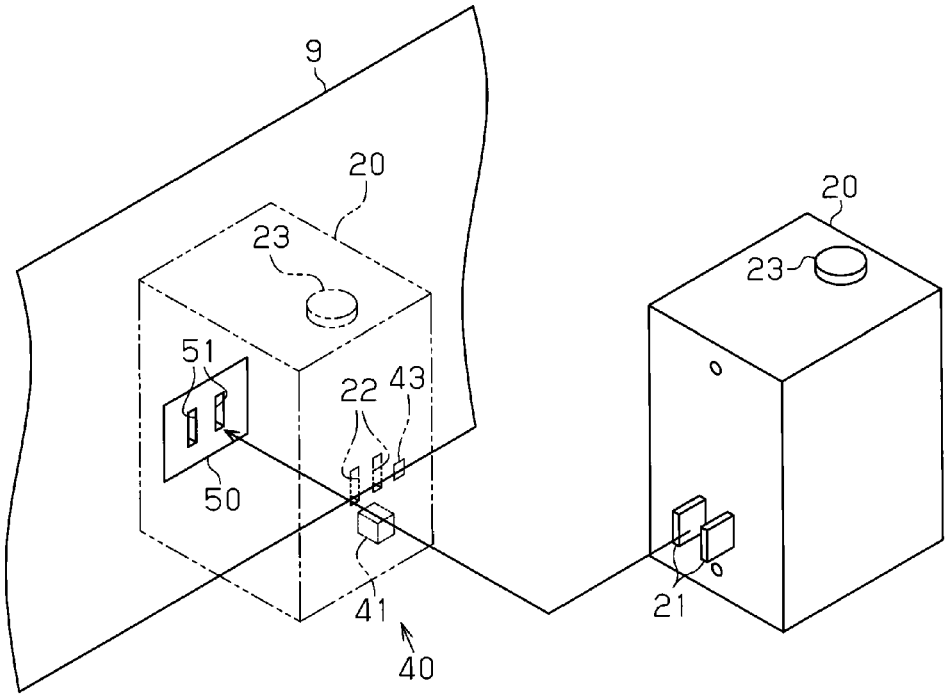
FIG. 5 is a perspective view showing the outlet and outlet unit.

As shown in FIG. 5, a household outlet 50 is arranged in a wall of a building for a household or the like. The connection terminals 21 of the outlet unit 20 are plugged into outlet ports 51 of the household outlet 50 to connect the outlet unit 20 to the outlet 50.

Figure 6:
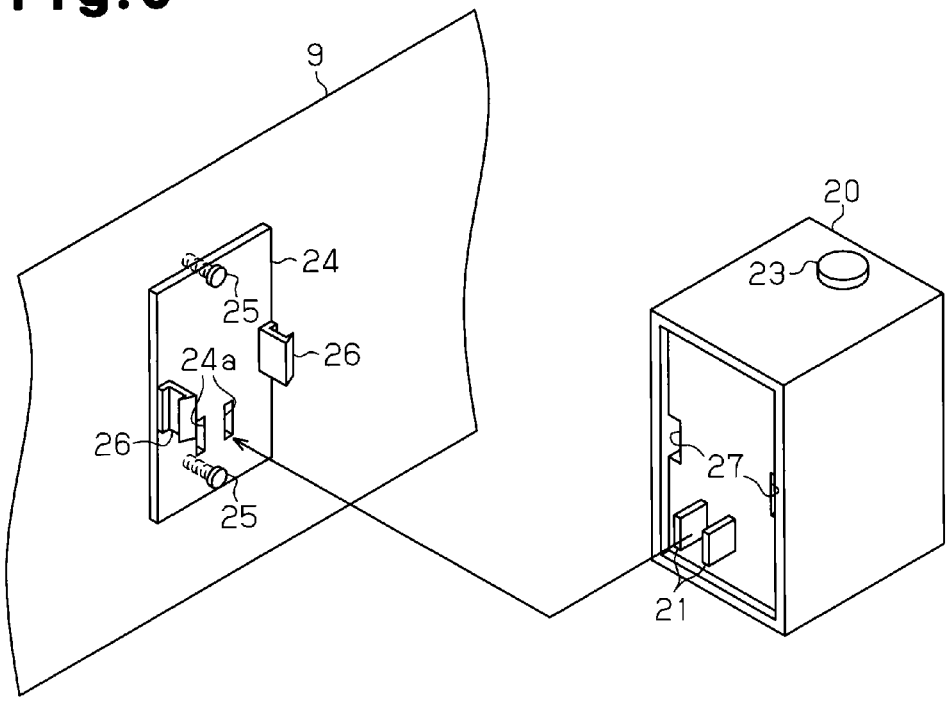
FIG. 6 is a perspective view showing the outlet unit coupled to the outlet.

As shown in FIG. 6, a fastening plate 24 is arranged on the rear surface of the outlet unit 20 to fasten the outlet unit 20 to a wall 9, which includes the outlet. The fastening plate 24 is a discrete member. The fastening plate 24 includes insertion holes 24*a*, which have the same size as the outlet ports 51. Further, the fastening plate 24 includes two hooks 26, which are formed in correspondence with two sockets 27 formed in the rear surface of the outlet unit 20.

The insertion holes 24*a* of the fastening plate 24 are first aligned with the outlet ports 51. In this state, the fastening plate 24 is fixed by screws 25 to the wall 9.

Subsequently, the connection terminals 21 of the outlet unit 20 are aligned with the insertion holes 24*a*, and the rear surface of the outlet unit 20 is pushed against the fastening plate 24. This forces the connection terminals 21 into the outlet ports 51 of the outlet 50, hooks the hooks 26 to the sockets 27, and fastens the outlet unit 20 to the wall 9. When the outlet unit 20 is fastened to the wall 9, it is preferable that the hooks 26 and sockets 27 be hidden in the rear surface of the outlet unit 20. The rear surface (sockets 27) of the outlet unit 20 and the fastening plate (hooks 26) form a coupling structure.

The outlet unit 20 includes an interlocking mechanism (not shown) that prevents separation of the hooks 26 from the sockets 27. The interlocking structure permits removal of the hooks 26 from the sockets 27 under the condition that electronic key verification has been successful.

Figure 3:
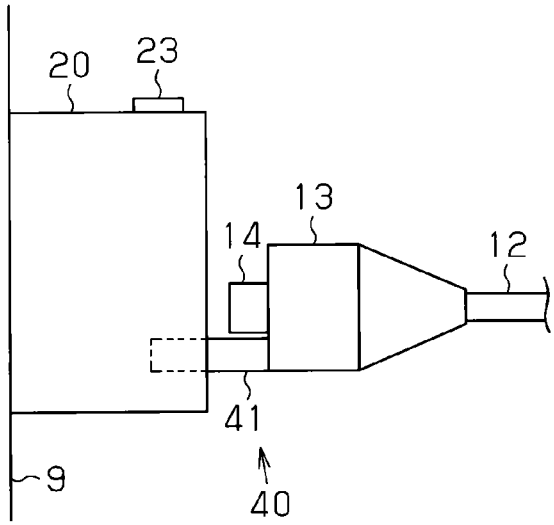
FIG. 3 is a side view showing the outlet unit in a locked state.
Figure 4:
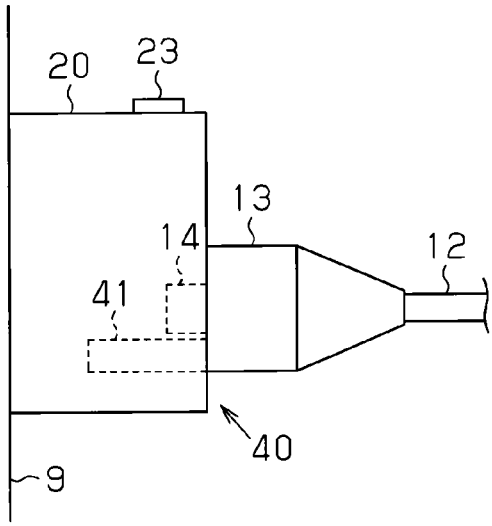
FIG. 4 is a side view showing the outlet unit in an unlocked state.

The operation for connecting the connection plug 13 to the outlet unit 20 to charge the battery 4 with the power feeding plug 11 and the function of the lock mechanism 40 will now be discussed with reference to FIGS. 2 to 4.

When the connection plug 13 is not connected to the outlet unit 20, the lock mechanism 40 is in the locked state. When the connection plug 13 was previously disconnected from the outlet ports 22, the lock mechanism 40 was switched to the locked state. Thus, the operator operates the release switch 23 of the outlet unit 20. When the authorized user is carrying the authorized electronic key 80, electronic key ID verification is successful. When the lock control unit 31*c* checks the verification unit 31*b* and confirms that electronic key ID verification has been successful, the lock control unit 31*c* supplies current to the solenoid 42 to retract the lock bar 41 into the outlet unit 20 and switch the lock mechanism 40 to the unlocked state. This allows for the operator to connect the plug terminals 14 of the connection plug 13 to the outlet ports 22 of the outlet unit 20 (refer to FIG. 4).

Then, the operator connects the power feeding plug 11 to the power receiving connector 5. The locking device 7 of the power receiving connector 5 prevents unauthorized disconnection of the power feeding plug 11 from the power receiving connector 5. When the charging switch 15 is switched on in this holding state, the power feeding plug 11 starts charging the battery 4 through the power receiving connector 5.

For example, an unauthorized person, who is carrying an authorized connection plug or a non-registered connection plug, may approach the outlet ports 22 of the outlet unit 20. In such a case, the lock bar 41 is projected from the outlet unit 20 so that the lock bar blocks access to the outlet port 22 by a plug terminal of a non-registered connection plug. The unauthorized person is not aware of the release switch 23. Thus, the release switch 23 is not operated. In this case, neither the plug ID verification nor the key verification is started. Since the lock bar 41 abuts the authorized or non-registered connection plug, the unauthorized person cannot connect the authorized or non-registered connection plug to the outlet unit 20 (refer to FIG. 3). This prevents unauthorized electrical connection of the outlet unit 20 to the outlet 50.

For example, an unauthorized person that is aware of the operation of the release switch 23 but not carrying the electronic key 80 may attempt to connect a non-registered connection plug to the outlet unit 20. When the release switch 23 is operated, the verification unit 31*b* starts the plug ID verification. However, the plug ID verification performed on the non-registered connection plug is unsuccessful. Then, the verification unit 31*b* starts key verification. However, the unauthorized person is not carrying the electronic key 80. Thus, the key verification is unsuccessful. Since the plug ID verification and key verification are both unsuccessful, the lock control unit 31*c* keeps the solenoid 42 deactivated. As a result, the lock mechanism 40 remains in the locked state in which the lock bar 41 blocks access to the outlet port 22 by a plug terminal of a non-registered connection plug. In this manner, the outlet unit 20 prevents unauthorized electrical connection of the connection plug to the outlet 50.

When the charging of the battery 4 is completed, the operator unlocks the locking device 7 to disconnect the power feeding plug 11 from the power receiving connector 5.

Then, when the detection sensor 43 detects disconnection of the connection plug 13 from the outlet unit 20, the lock control unit 31*c* supplies current to the solenoid 42 to project the lock bar 41 out of the outlet unit 20 and switch the lock mechanism 40 to the locked state. This prevents an unauthorized person from connecting a non-registered connection plug in an unauthorized manner to the outlet unit 20. The operator then stores the charging cable unit, which is disconnected from the power receiving connector 5 and the outlet unit 20, in the vehicle, for example.

The procedures for connecting a non-registered connection plug when the operator is carrying the authorized electronic key 80 will now be discussed. The operator first pushes the release switch 23 while carrying the electronic key 80. In this case, after the plug ID verification is performed, the verification unit 31*b* performs electronic ID verification, which is successful. When the lock control unit 31*c* recognizes that the electronic key ID verification was successful, the lock control unit 31*c* switches the lock mechanism 40 to the unlocked state. This allows for the non-registered connection plug to be connected to the outlet ports 22 of the outlet unit 20. Thus, the operator can connect the non-registered connection plug to the outlet ports 22 of the outlet unit 20.

The procedures taken by an operator carrying the authorized electronic key 80 to register a new non-registered connection plug to the outlet unit 20 will now be described. The operator who is carrying the electronic key 80 first brings the non-registered connection plug near the outlet unit 20 and, for example, operates a button (not shown) on the electronic key 80 following predetermined registration procedures to transmit a registration request signal from the electronic key 80 to the outlet unit 20. When the UHF receiver 33 receives the registration request signal, the plug registration unit 31*d* starts the registration operation. The plug registration unit 31*d* transmits drive radio waves from the immobilizer amplifier 36 to activate the transponder of the non-registered connection plug and obtain the transponder code of the non-registered connection plug.

Here, the plug registration unit 31*d* checks whether or not the newly obtained transponder code has already been registered. When the transponder code has not yet been registered, the new transponder code obtained by the verification unit 31*b* is registered to the memory 31*a*. Thus, the transponder code of the new connection plug is registered to the outlet unit 20. The newly registered connection plug is then connectable to the outlet unit 20 without the need for the electronic key 80 from the next time.

As described above, the outlet unit 20 of the present embodiment includes the verification unit 31*b* and the lock mechanism 40. The verification unit 31*b* is provided with a verification function, and the lock mechanism 40 includes the lock bar 41 provided with a locking function. The connection plug 13 is not directly connected to the household outlet 50 but indirectly connected via the outlet unit 20 to the household outlet 50. When the authorized user connects the connection plug, ID verification is successful for at least one of the connection plug and the electronic key. This activates the solenoid 42 and switches the lock mechanism 40 to the unlocked state. In this state, the connection plug is electrically connectable to the outlet 50 via the outlet unit 20.

When an unauthorized person attempts to connect a connection plug, the connection plug and the electronic key both do not succeed ID verification. Thus, the solenoid 42 remains deactivated, the lock mechanism 40 remains in the locked state, and the connection plug cannot be connected to the outlet unit 20. Accordingly, the connection plug cannot be electrically connected to the outlet 50. This prevents an unauthorized person from connecting an unauthorized connection plug to the outlet 50 and stealing electricity.

The embodiment discussed above has the advantages described below.

(1) The outlet unit 20, which is provided with the verification function and the lock function (unauthorized connection prevention function), is fastened to the outlet 50. This prevents an unauthorized person from connecting a connection plug to the outlet 50 in an unauthorized manner.

(2) When the detection sensor 43 detects disconnection of the connection plug 13 from the outlet unit 20, the lock mechanism 40 is automatically switched to the locked state. Thus, when disconnecting the connection plug 13 from the outlet unit 20, the lock mechanism 40 is prevented from being left in the unlocked state.

(3) Unauthorized connection of the connection plug 13 is prevented by a simple structure that projects the lock bar 41 out of the outlet unit 20 so that the connection plug 13 cannot be connected to the outlet unit 20. Further, the operator can visually recognize the locked state by looking at the projected lock bar 41.

(4) The connection plug 13 includes the transponder 16, and the connection plug 13 performs ID verification with the outlet unit 20. Thus, as long as the authorized connection plug 13 is held in person, the connection plug 13 can be freely coupled to the outlet unit 20.

(5) The result of the ID verification performed on the electronic key 80 (electronic key ID verification) is used to determine whether or not the authorized operator is connecting the connection plug 13. This allows for determination of whether or not the outlet 50 is being used in an unauthorized manner and makes it further difficult for an unauthorized connection plug to be connected to the outlet 50.

(6) The conventional electronic key 80 of the electronic key system 70 installed in the vehicle 1 is used as a communication terminal by the outlet verification system 30. This prevents unauthorized connection of the connection plug 13 to the outlet 50 without using a separate communication terminal dedicated for the outlet verification system 30.

(7) The lock mechanism 40 is switched to the unlocked state when ID verification performed on the electronic key 80 (electronic key ID verification) is successful. Thus, as long as the authorized electronic key 80 is carried in person, even a non-registered connection plug can be connected to the outlet unit 20. In this manner, the outlet unit 20 allows for use of a connection plug that does not include the transponder 16 and is thereby versatile.

(8) The outlet unit 20 includes the plug registration unit 31*d*. Thus, a new connection plug that includes the transponder 16 can be used.

(9) The outlet unit 20 is an integrated unit that may be connected to various types of the household outlet 50 at any time.

(10) The operation of the release switch 23 is one condition for switching the lock mechanism 40 to the unlocked state. Thus, the connection plug 13 is connectable to the outlet unit 20 only when the authorized user intentionally operates the release switch 23. This eliminates the need to perform unnecessary ID verification and saves power.

It should be apparent to those skilled in the art that the present invention may be embodied in many other specific forms without departing from the spirit or scope of the invention. Particularly, it should be understood that the present invention may be embodied in the following forms.

Instead of the keep solenoid 42, a pull solenoid that pulls the lock bar 41 only when performing unlocking may be used.

The lock bar 41 may be driven with a drive source other than a solenoid such as a motor.

Instead of the lock mechanism 40 that includes the lock bar 41 and the solenoid 42, for example, a mechanical operation member such as a lever that is manually operable only when the ID verification performed by the verification unit 31*b* is successful may be used to prevent connection of the connection plug 13 to the outlet unit 20.

The structure of the lock mechanism 40 is not limited as long as the plug terminals 14 of the connection plug 13 can be prevented from being connected to the outlet ports 22 of the outlet unit 20. For example, the lock mechanism 40 may include a shutting member that at least partially shuts the outlet ports 22 when the lock mechanism 40 is in the locked state.

In the above-discussed embodiment, the fastening plate 24 of the outlet unit 20 is fastened to the wall 9 that includes the outlet 50, with the hooks 26 hooked to the sockets 27. However, a different structure may be used to fasten the outlet unit 20 to the outlet 50. For example, a structure that includes a hook, which is hooked to the household outlet 50, and a lock mechanism, which locks the hook, may be used to restrict unauthorized disconnection of the outlet unit 20.

Figure 7:
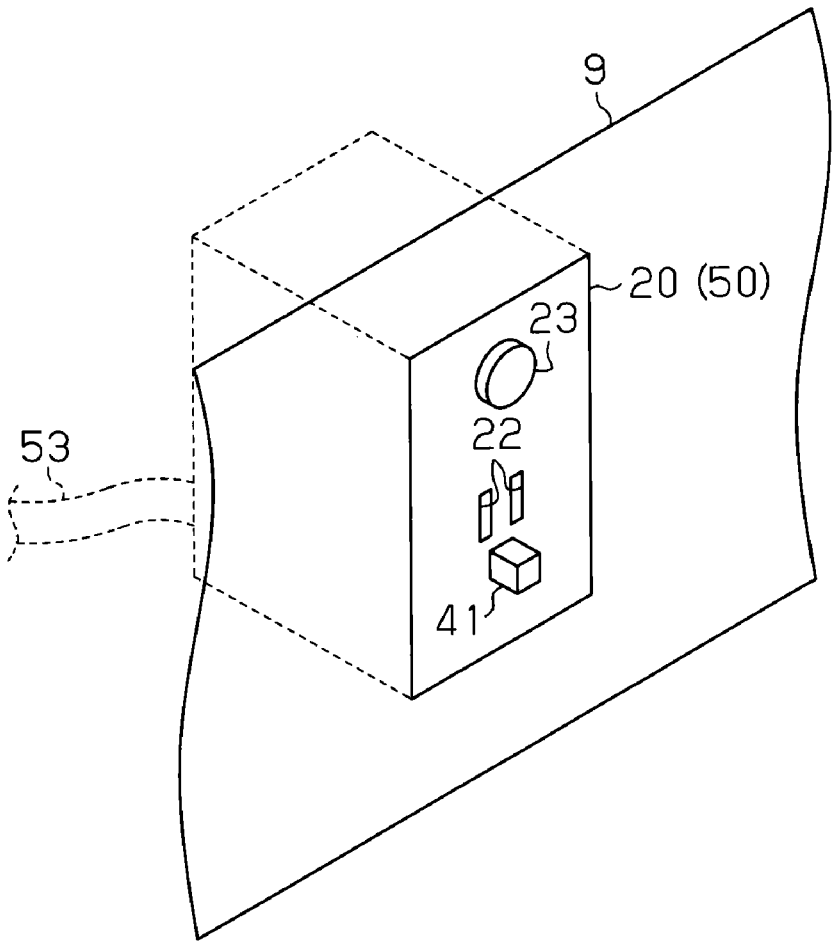
FIG. 7 is a perspective view showing an embedment type outlet unit.

In the above-discussed embodiment, the outlet unit 20 is connected to the outlet 50. However, the outlet 50 may be eliminated, and the outlet unit 20 may be directly connected to commercial power supply cable 53 as shown in FIG. 7. In this example, the outlet unit 20 is of an embedment type and its front surface is exposed from the wall 9.

In the above-discussed embodiment, the lock ECU 31 maintains the lock mechanism 40 in the locked state when the release switch 23 is operated and ID verification is unsuccessful. However, the verification unit 31*b* may perform ID verification again when the release switch is being operated. In more detail, when the release switch 23 is operated and ID verification is unsuccessful, a further ID verification may be performed.

In the above-discussed embodiment, the connection plug 13 includes the transponder 16 but is not limited to such a structure. For example, an antenna, transmitter, and receiver similar to those of the electronic key 80 may be installed in the connection plug 13.

In the above-discussed structure, the transponder 16 may be eliminated from the connection plug 13.

In the above-discussed embodiment, the electronic key system 70 and the outlet verification system may use radio waves of frequencies other than LF and UHF. Further, the frequency of the radio waves transmitted from the vehicle 1 to the electronic key 80 may be the same as or different from the frequency of the radio waves transmitted from the electronic key 80 to the vehicle 1.

In the above-discussed embodiment, instead of performing ID verification on the electronic key 80, the operator may be determined as being authorized through other processes such as biometric authentication.

The embodiment discussed above is applied to the plug-in hybrid vehicle 1 but also may be applied to an electric vehicle or the like. Further, the present invention is not limited to vehicles and may be applied a different apparatus or machine.

In the above-discussed embodiment, the lock mechanism 40 of the present example is not limited to buildings and may be applied to any location as long as there is an apparatus or machine that includes an outlet 50.

The present examples and embodiments are to be considered as illustrative and not restrictive, and the invention is not to be limited to the details given herein, but may be modified within the scope and equivalence of the appended claims.

What is claimed is:

1. An unauthorized connection prevention device for use with an outlet, the outlet being electrically connectable to a connection plug arranged on a basal end of a charging cable that supplies commercial power to a power receiving connector, the unauthorized connection prevention device comprising:

a verification circuit that performs verification to determine whether or not an authorized operator is electrically connecting the connection plug to the outlet; and a lock mechanism that switches, in accordance with a result of the verification performed by the verification circuit, between an unlocked state, which permits connection of the connection plug to an outlet port that is electrically connected to the outlet, and a locked state, which prohibits connection of the connection plug to the outlet port.

2. The unauthorized connection prevention device according to claim 1, wherein the lock mechanism is automatically switched to the locked state when the connection plug is disconnected from the outlet port.

3. The unauthorized connection prevention device according to claim 1, wherein the lock mechanism, in the locked state, projects a restriction member out of the outlet so that the restriction member blocks access to the outlet port by a plug terminal of a non-registered connection plug.

4. The unauthorized connection prevention device according to claim 1, further comprising a plug ID verification wireless communication circuit that performs wireless communication with an authentication tag of the connection plug to obtain an ID of the authentication tag, wherein the verification circuit verifies the ID of the authentication tag obtained by the plug ID verification wireless communication circuit.

5. The unauthorized connection prevention device according to claim 1, wherein the lock mechanism includes an electric restriction mechanism, and the unauthorized connection prevention device further comprises a control circuit connected to the electric restriction mechanism and the verification circuit, wherein the control circuit controls activation of the electric restriction mechanism in accordance with the verification result to switch between the locked state and the unlocked state.

6. The unauthorized connection prevention device according to claim 1, further comprising a mechanical operation unit, wherein the lock mechanism continues to remain in the locked state unless the mechanical operation unit is operated.

7. The unauthorized connection prevention device according to claim 1, further comprising a communication terminal verification wireless communication circuit that performs wireless communication with a communication terminal carried by the operator to obtain an ID of the communication terminal, wherein the verification circuit verifies an ID of the communication terminal obtained by the communication terminal verification wireless communication circuit.

8. The unauthorized connection prevention device according to claim 7, wherein the communication terminal is used by a wireless authentication system that performs ID verification through wireless communication with a master device in which the power receiving connector is arranged.

9. The unauthorized connection prevention device according to claim 7, further comprising:

a mechanical operation unit; and a non-registered plug connection circuit connected to the mechanical operation unit and the verification circuit, wherein the non-registered plug connection circuit switches the lock mechanism from the locked state to the unlocked state to permit connection of a non-registered connection plug when determining that ID verification of the communication terminal has been successful and that the mechanical operation unit has also been operated.

10. The unauthorized connection prevention device according to claim 7, further comprising a registration circuit connected to the verification circuit, wherein the registration circuit enables registration of an ID code for a new connection plug when ID verification of the communication terminal is successful.

11. An outlet unit connectable to a conventional power outlet and to a connection plug arranged on a basal end of a power feeding plug that supplies commercial power to a power receiving connector, the outlet unit comprising:

an outlet port connectable to a plug terminal of the connection plug;

a verification circuit that performs verification allowing for determination of whether an authorized operator is performing an operation for connecting the connection plug to the outlet unit;

a lock mechanism switches, in accordance with a result of the verification performed by the verification circuit, between an unlocked state, which permits connection of the connection plug to the outlet port, and a locked state, which prohibits connection of the connection plug to the outlet port; and a coupling structure that connects the outlet unit to the conventional power outlet, wherein the outlet unit prevents an unauthorized person from disconnecting the outlet unit from the conventional power outlet in an unauthorized manner.

12. An electricity antitheft system for a commercial power outlet, the electricity antitheft system comprising:

an outlet unit fastened to the commercial power outlet in an irremovable manner;

a connection plug including a plug terminal connectable to an outlet port of the outlet unit, wherein the connection plug is capable of performing wireless communication with the outlet unit; and an electronic key capable of performing wireless communication with the outlet unit;

wherein the outlet unit includes:

a control unit that performs wireless communication with the connection plug to determine whether or not the connection plug is authorized and performs wireless communication with the electronic key to determine whether or not the electronic key is authorized; and a lock bar controlled and driven by the control unit and moved between a retraction position, in which the lock bar is retracted into the outlet unit, and a projection position, in which the lock bar is projected out of the outlet unit from near the outlet port so that the lock bar blocks access to the outlet port by the plug terminal;

wherein the control unit moves the lock bar to the retraction position when determining that at least one of the connection plug and the electronic key is authorized; and the control unit moves the lock bar to the projection position when determining that the connection plug and the electronic key are both unauthorized.

* * * * *